US008397519B2

(12) United States Patent
Loibl et al.

(10) Patent No.: US 8,397,519 B2
(45) Date of Patent: Mar. 19, 2013

(54) BOTTLE STAND WITH ACTIVE COOLING

(75) Inventors: Gregory H. Loibl, Hyde Park, NY (US); George Sidebotham, Babylon, NY (US); Michael B. Gutierrez, Roselle, NJ (US)

(73) Assignee: The Cooper Union for the Advancement of Science and Art, New York, NY (US)

( * ) Notice: Subject to any disclaimer, the term of this patent is extended or adjusted under 35 U.S.C. 154(b) by 612 days.

(21) Appl. No.: 12/403,766

(22) Filed: Mar. 13, 2009

(65) Prior Publication Data

US 2010/0058776 A1 Mar. 11, 2010

Related U.S. Application Data

(60) Provisional application No. 61/036,528, filed on Mar. 14, 2008.

(51) Int. Cl.
*F25B 21/02* (2006.01)
*B65B 63/08* (2006.01)
*F25D 3/08* (2006.01)

(52) U.S. Cl. ..... 62/3.64; 62/3.62; 62/60; 62/457.1; 62/457.3; 62/457.8

(58) Field of Classification Search ..... 62/3.64, 62/3.62, 60, 457.1, 457.3, 457.8, 530, 246; 211/74, 77
See application file for complete search history.

(56) References Cited

U.S. PATENT DOCUMENTS 81,814 A * 9/1868 Neuhaus ..... 62/297
1,249,341 A * 12/1917 Name not available ..... 248/139
2,102,982 A * 12/1937 Taylor ..... 211/1.53
2,817,458 A * 12/1957 Amigone ..... 222/131
2,817,459 A * 12/1957 Amigone ..... 222/131
3,718,007 A * 2/1973 Randrup ..... 62/63
4,350,253 A * 9/1982 Rusteberg ..... 211/74
4,531,381 A * 7/1985 Toro et al. ..... 62/372
(Continued)

FOREIGN PATENT DOCUMENTS

FR 2788677 * 7/2000
FR 2788677 A1 * 7/2000
(Continued)

OTHER PUBLICATIONS

S.B. Riffat, Xiaoli Ma, "Thermoelectrics: a review of present and potential applications", Applied Thermal Engineering 23 (2003) 913-935.*

(Continued)

*Primary Examiner* — Frantz Jules
*Assistant Examiner* — Henry Crenshaw
(74) *Attorney, Agent, or Firm* — Kane Kessler, P.C.; Barry E. Negrin

(57) ABSTRACT

A bottle display stand with an active cooling function. The display stand includes a housing having an opening into which a beverage bottle may be inserted. A reservoir for containing a cooling medium is disposed inside the hollow housing. A pump, in fluid communication with the reservoir, recirculates the cooling medium from the reservoir through a fluid passageway and out of a spray jet. The spray jet is aimed at an upper region of the bottle, preferably the shoulder. Cooling medium travels down the body of the bottle substantially in a thin film that does not obscure the bottle or its label and creates a waterfall- or fountain-type effect that is extremely aesthetically pleasing without splashing, dripping, or a similar mess. Simultaneously, the thin film of cooling medium chills the beverage and keeps it cold. A cooling unit may optionally remove heat from the cooling medium.

17 Claims, 10 Drawing Sheets

U.S. PATENT DOCUMENTS

| | | | | |
|---|---|---|---|---|
| 4,568,369 | A * | 2/1986 | Destruhaut | 62/64 |
| 4,825,665 | A * | 5/1989 | Micallef | 62/372 |
| 4,899,553 | A * | 2/1990 | Drummond, III | 62/372 |
| 5,269,156 | A * | 12/1993 | van de Velde et al. | 62/457.4 |
| 5,505,054 | A * | 4/1996 | Loibl et al. | 62/63 |
| 5,647,508 | A * | 7/1997 | Ronci et al. | 222/23 |
| 6,089,124 | A * | 7/2000 | Murphy | 81/3.39 |
| 6,206,298 | B1 * | 3/2001 | Ting | 239/20 |
| 6,209,733 | B1 * | 4/2001 | Higgins et al. | 211/74 |
| 6,234,325 | B1 * | 5/2001 | Higgins et al. | 211/74 |
| 6,234,326 | B1 * | 5/2001 | Higgins et al. | 211/74 |
| 6,357,251 | B1 * | 3/2002 | Marks | 62/425 |
| 6,394,288 | B1 * | 5/2002 | Hartwall | 211/74 |
| 6,397,624 | B1 | 6/2002 | Horwell | |
| 6,460,483 | B1 * | 10/2002 | Northrop et al. | 119/74 |
| 6,550,271 | B2 * | 4/2003 | Silbert | 62/457.4 |
| 6,948,321 | B2 * | 9/2005 | Bell | 62/3.2 |
| 7,178,343 | B2 * | 2/2007 | Linder | 62/3.6 |
| 7,419,072 | B1 * | 9/2008 | Vanella | 222/113 |
| 2004/0089621 | A1 * | 5/2004 | Gangloff | 211/74 |
| 2005/0086946 | A1 * | 4/2005 | Song et al. | 62/3.2 |
| 2005/0126209 | A1 * | 6/2005 | Shimazaki | 62/457.4 |
| 2005/0166605 | A1 * | 8/2005 | Forbes et al. | 62/64 |
| 2006/0043035 | A1 * | 3/2006 | Madsen | 211/74 |
| 2006/0053805 | A1 * | 3/2006 | Flinner et al. | 62/3.2 |
| 2006/0163869 | A1 * | 7/2006 | Adler et al. | 283/81 |
| 2006/0213206 | A1 | 9/2006 | Linder | |
| 2007/0017246 | A1 * | 1/2007 | Hoare et al. | 62/457.8 |
| 2007/0289977 | A1 * | 12/2007 | Zhuang | 220/592.16 |
| 2009/0007572 | A1 * | 1/2009 | Bell | 62/3.7 |
| 2010/0058776 | A1 * | 3/2010 | Loibl et al. | 62/3.3 |

FOREIGN PATENT DOCUMENTS

| | | | |
|---|---|---|---|
| JP | 2000190920 | A * | 7/2000 |
| JP | 3186119 | B2 | 7/2001 |
| WO | 2008000943 | A1 | 1/2008 |

OTHER PUBLICATIONS

English translation of FR2788677.*

PCT International Application No. PCT/US2009/037105, International Search Report dated Oct. 16, 2009.

* cited by examiner

BOTTLE STAND WITH ACTIVE COOLING

RELATED APPLICATIONS

Domestic priority is claimed from U.S. Provisional Patent Application No. 61/036,528 filed Mar. 14, 2008, entitled "Wine Bottle Stand with Active Cooling", the entirety of which is incorporated by reference herein.

BACKGROUND OF THE INVENTION

1. Field of the Invention

The invention is related to wine stands or buckets, and more specifically to devices used to chill wine bottles and similar beverage containers and keep them cool while simultaneously providing ambience and entertainment.

2. Description of Related Art

It is common for a person enjoying a bottle of wine or sparkling wine to desire to have the wine kept cool and maintained at a cool temperature suitable for drinking. Whether in a restaurant or at home, a wine drinker will typically have pre-chilled the wine and then, while enjoying the wine, keep the bottle in a bucket filled with ice water. As another alternative, the wine drinker may pour some wine and return the wine bottle to a refrigerator until another serving of wine is desired. Other beverages such as vodka or gin are also sometimes desired to be consumed at ice cold temperatures at a bar or party. However, other than leaving the bottle in a bucket of ice, it is difficult to keep the beverage remaining in the bottle ice cold.

These methods are somewhat effective, however they suffer from several drawbacks. First, if the wine or other beverage bottle is in a bucket of ice water, the ice and/or the bucket itself partially or completely obscure the label of the wine bottle or block the label from view. Should the wine be returned to the refrigerator, it is, of course, completely hidden from view. Should one of the wine drinkers wish to see the bottle, e.g., to see what she is drinking or to learn more about the wine, she would have to remove it from the ice bucket or refrigerator. If from the former, the ice water will drip from the wine bottle and make a fair amount of mess. If from the latter, the interested party must get up and go to the refrigerator, an act that may be considered rude at someone else's home and may be impossible at a restaurant. Similarly, a party host or bar-goer may wish to show off or display a particularly expensive brand of wine, vodka, or the like. One cannot display a bottle adequately inside an ice bucket. There are artistic stands that display one or more bottles of wine, however these do so in open air and have no cooling or chilling function whatsoever. Placing a bottle that is in the process of being consumed on such a conventional stand will cause it to warm to room temperature rapidly.

SUMMARY OF THE INVENTION

The invention is a beverage bottle display stand with an active cooling function. The display stand includes a hollow housing having an opening into which a wine bottle or similar beverage container may be inserted. A reservoir for containing ice water or another cooling medium is disposed inside the hollow housing. A pump, in fluid communication with the reservoir, recirculates the cooling medium from the reservoir through a fluid passageway and out of a spray jet, preferably disposed at the top portion of the housing. The spray jet is aimed at an upper region of the bottle, preferably the shoulder of the bottle, the portion of the bottle where the neck and the main body meet. The inventive bottle display stand causes cooling medium to travel down the body of the bottle substantially in a thin film that does not obscure the bottle or its label and yet creates a waterfall- or fountain-type effect that is extremely aesthetically pleasing without splashing, dripping, or a similar mess. Simultaneously, the thin film of cooling medium chills the beverage and keeps it cold.

Preferably, the top portion of the inventive display stand includes a hook for receiving the neck of a bottle so that the bottle is held in a substantially upright position when the base of the bottle is sitting within the opening of the housing. More preferably, the hook is hollow and has the spray jet disposed in fluid communication therewith; in this embodiment, the cooling medium is conducted up the housing, through the hook, out of the spray jet, and onto the shoulder of the wine bottle. The hook is preferably pivotably attached to the top portion of the housing so as to accommodate wine bottles of different sizes. More specifically, the hook is adapted to accommodate bottles of different lengths having different shoulder heights. The hook may optionally be provided with a no-slip surface and/or adhesive for better securement of the bottle.

The inventive bottle stand may further include a rounded base disposed within the housing adapted to engage a punt of a bottle. The base may be removable. Optionally, the base may be at least partially light transmissible and further include at least one light source disposed within the base adapted to illuminate a bottle placed thereon. Additional lights may be disposed in various locations on the device.

Preferably, the inventive display stand may include a cooling unit in thermal communication with the reservoir, adapted to remove heat from the cooling medium. The cooling unit preferably includes a thermoelectric chip having a cold side and a hot side, the cold side being in thermal communication with the reservoir. If the punt-engaging base is provided, the cold side may at least partially be disposed within the base and is also at least partially in thermal communication with the wine bottle disposed on the base. Optionally, the current applied to the thermoelectric chip may be selectively reversed, thereby causing the hot side to be in thermal communication with the reservoir and/or bottle and thus warm the reservoir and bottle.

At least one positioning rib is preferably provided, projecting from an interior of the housing below the rim of the opening, adapted to space the bottle away from the rim. By keeping the bottle a distance away from the rim of the opening, cooling medium flowing down the bottle will not flow down along the outside of (and thus exit) the housing. Alternatively or in addition, a positioning flange may be provided disposed within the housing below a rim of the opening, adapted to space the bottle away from the rim so as to prevent the cooling medium flowing down the bottle from exiting the housing. The positioning flange may preferably further include at least one drainage hole, wherein cooling medium flowing down the bottle is at least partially collected within the positioning flange, exits the positioning flange via the at least one drainage hole, and returns to the reservoir. Optionally, the positioning flange is angled towards the at least one drainage hole so that cooling medium collected in the flange flows downward in the flange towards the drainage hole.

DETAILED DESCRIPTION OF THE INVENTION AND DRAWINGS

Figure 1:
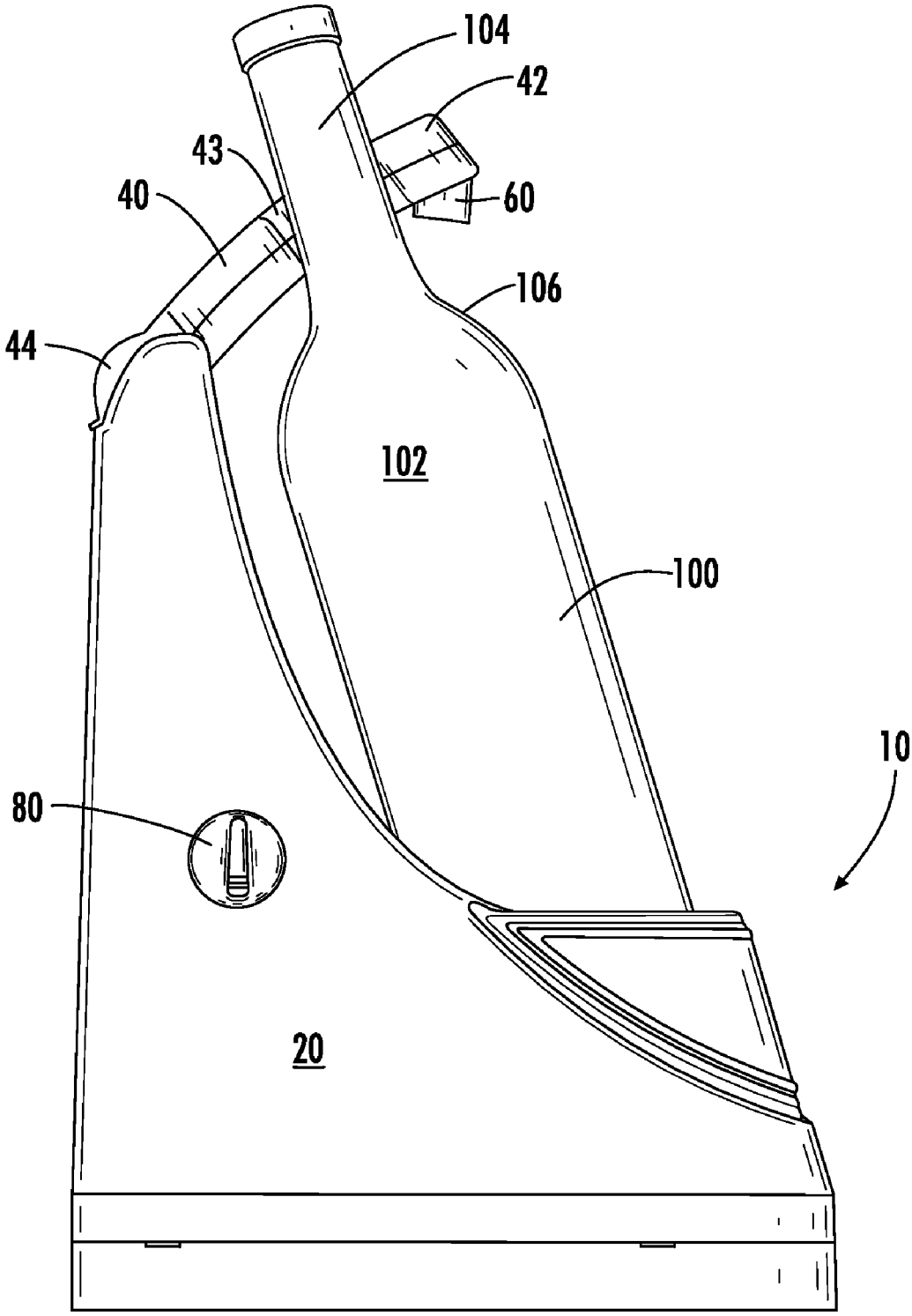
FIG. 1 is a side elevation view of a wine bottle display stand in accordance with the invention, displaying a bottle of wine.
Figure 2:
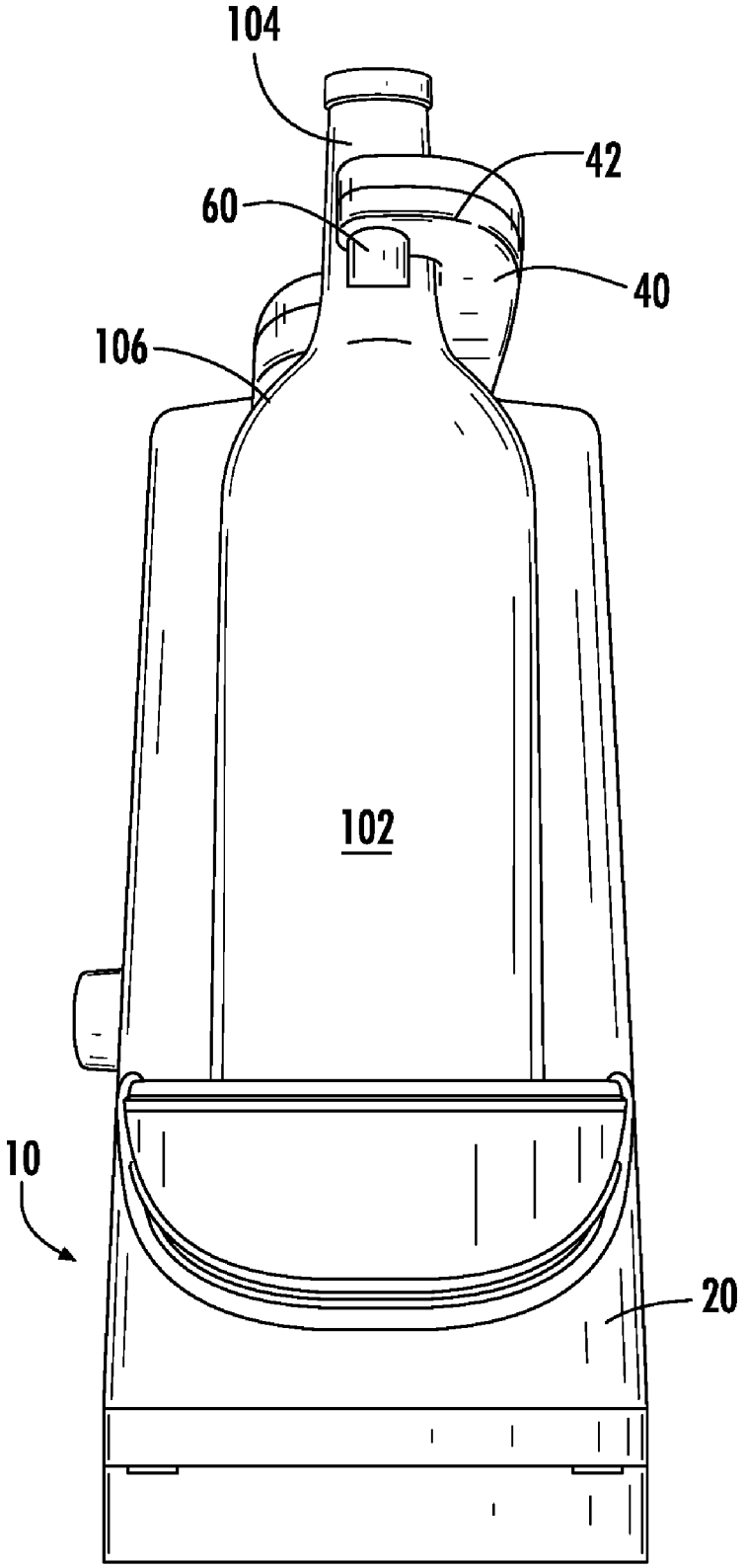
FIG. 2 is a front elevation view of a wine bottle display stand in accordance with the invention, displaying a bottle of wine.
Figure 3:
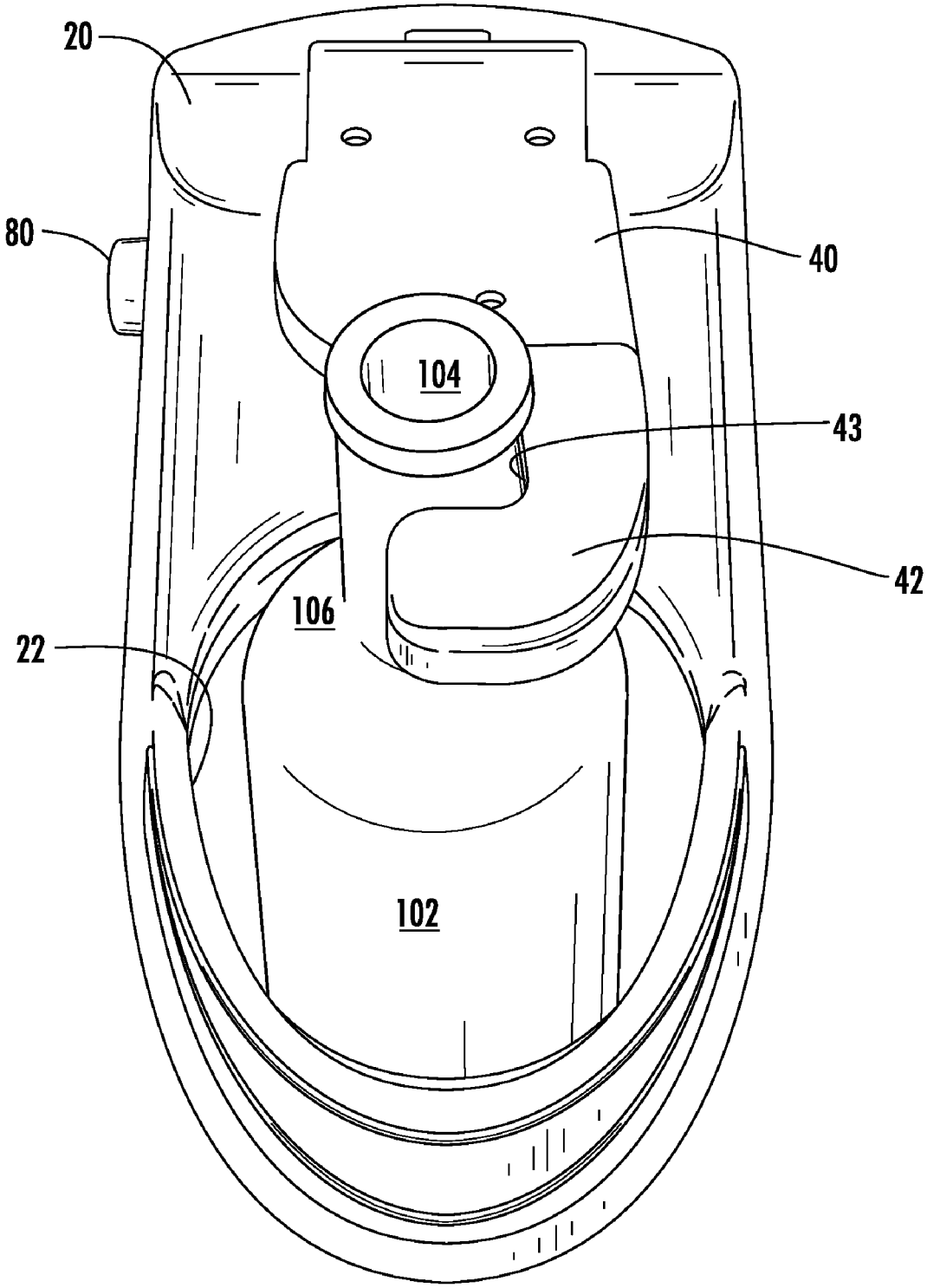
FIG. 3 is a top perspective view of a wine bottle display stand in accordance with the invention, displaying a bottle of wine.
Figure 4:
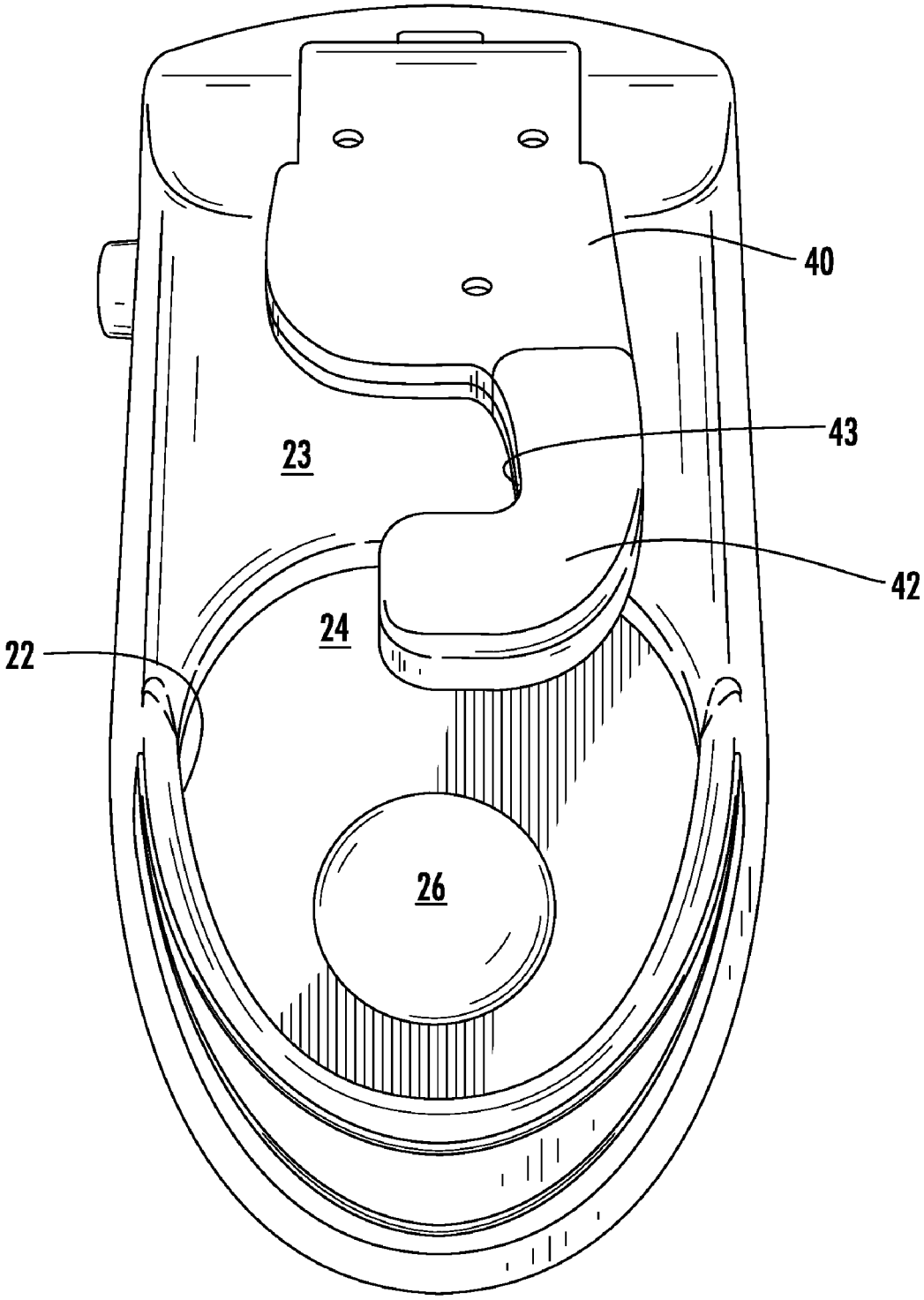
FIG. 4 is a top perspective view of a wine bottle display stand in accordance with the invention (with no wine bottle).

Description of the invention will now be given with reference to FIGS. 1-10. It should be understood that these figures are exemplary in nature and in no way serve to limit the scope of the invention which is defined by the claims appearing hereinbelow.

The inventive bottle stand 10 includes a main housing 20 which is substantially hollow. As shown in FIGS. 3-5, and 7, an opening 22 is provided in housing 20 to allow for a wine bottle 100 or similar beverage bottle to be inserted at least partially within housing 20. The interior of housing 20 includes a reservoir 24 for holding a quantity of cooling medium (not shown) which is used to keep the wine contained within wine bottle 100 chilled or cold. A preferred cooling medium is water because it is inexpensive, readily available, and extremely safe.

Figure 5:
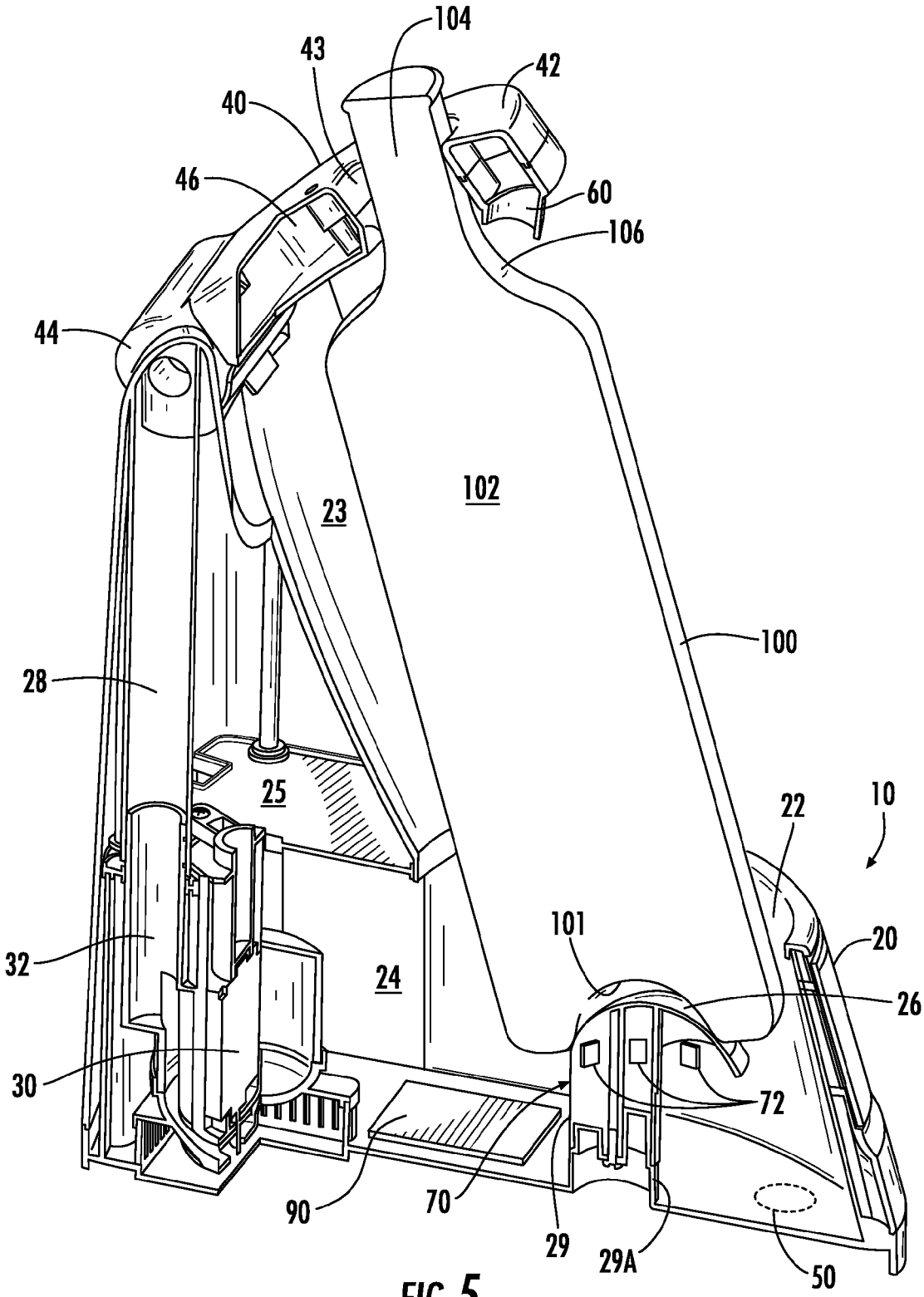
FIG. 5 is a side partial perspective sectional view of a wine bottle display stand in accordance with the invention, displaying a bottle of wine.
Figure 6:
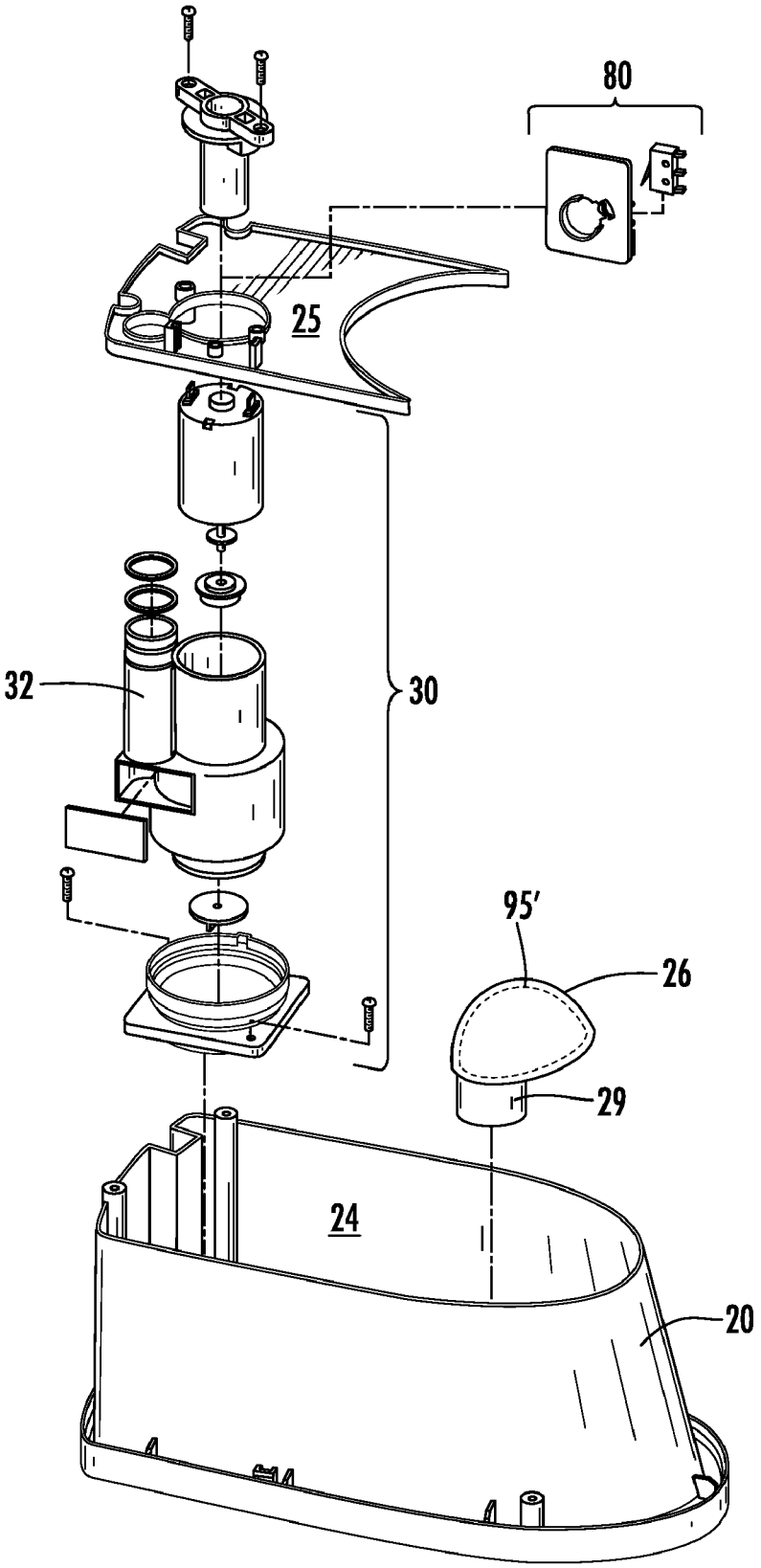
FIG. 6 is an exploded perspective view of the pump system of a wine bottle display stand in accordance with the invention.

Since many wine bottles 100 include a punt 101 (the concave portion in the base of the bottle shown in FIG. 5), a convex rounded base 26 is optimally disposed within the interior of housing 20 just below opening 22. In this way, as shown in FIG. 5, punt 101 of bottle 100 can fit snugly and securely within opening 22 so that the bottle may be displayed at an angle for better viewing of the label, for aesthetic reasons, and for better disposition of the cooling medium around the entirety of bottle 100 (to be explained below). Base 26 may be made as a separate piece from the rest of housing 20 so as to accommodate wine bottles that do not have punts (i.e., have flat or substantially flat bottoms) and for ease of manufacturing. When separable, base 26 is securable onto a hub 29A in the housing (see FIG. 5) via securing sleeve 29. In one embodiment, removal of base 26 enables reservoir 24 to be drained via a hole or holes in hub 29A. In another embodiment, a separate drain hole 50 (see FIG. 5) is provided with a stopper (not shown). Alternatively, the user could also turn wine stand 10 substantially upside down and pour the cooling medium out via opening 22. In this last case, a smooth-flow lip may be provided around the edge of opening 22 to facilitate the pour and prevent dripping, spilling, or related mess.

As mentioned above, one preferred cooling medium is water, optionally ice water. However, as the device is being used and the water is sprayed onto a bottle, heat is transferred into the water (or other cooling medium) and the ice will melt. Eventually, all of the ice will melt and the temperature of the water will rise to room temperature, thereby failing to cool the bottle. One solution would be to keep adding ice to the reservoir and drain some liquid out periodically via drain hole 50. A preferred solution, however, is to employ a cooling unit 90 (see FIG. 5) in thermal communication with reservoir 24 and adapted to remove heat from the cooling medium.

Figure 10:
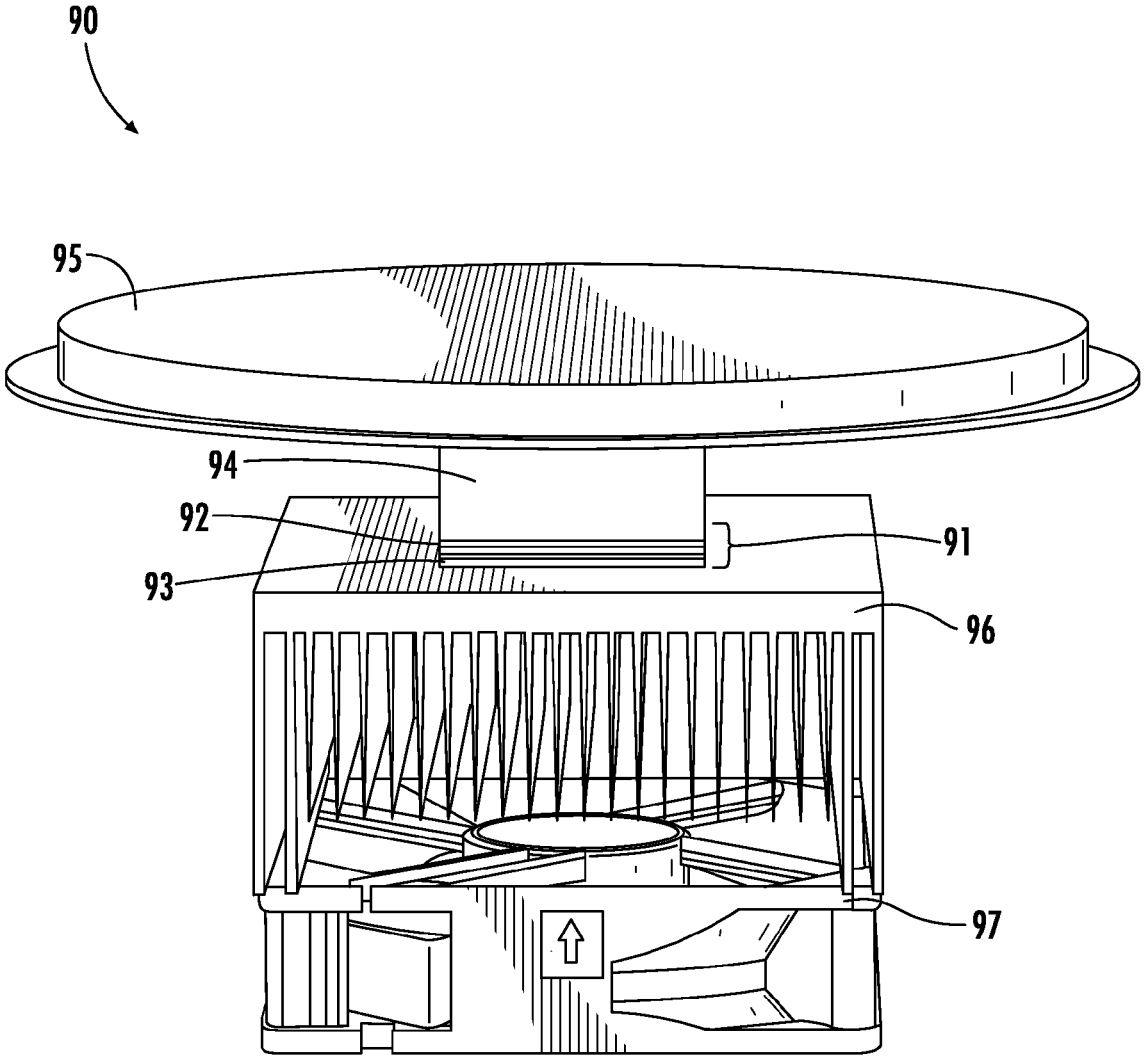
FIG. 10 is a front perspective view of a thermoelectric cooling unit shown schematically in FIG. 5 in accordance with the invention.

The preferred embodiment of the cooling unit 90 utilizes a thermoelectric or Peltier device so as to provide a very compact and quiet way to remove heat from the reservoir. (Alternatively, the cooling unit may take the form of a compressor as in a conventional refrigerator.) A perspective view of one configuration of cooling unit 90 is shown in FIG. 10. At the heart of cooling unit 90 is thermoelectric chip 91, which has a cold side 92 and a hot side 93 when a current is applied thereto. Cold block 94 is thermally coupled to cold side 92, and cold plate 95 is thermally coupled to cold block 94. Cold plate 95 is in thermal communication with at least reservoir 24, i.e., cold plate 95 may be disposed within reservoir 24 or it may be disposed just under the floor of reservoir 24 within housing 20. In FIG. 10, cold plate 95 is shown as a flat disc, however it may take any convenient geometry. For example, the cold plate may be rounded and disposed atop or within or part of base 26 as shown as cold plate 95' in FIG. 6. In this case, cold plate 95' is in thermal communication not only with reservoir 24 but also with the bottle sitting atop base 26. In this embodiment, the bottle is cooled via two distinct vectors of heat transfer: via the forced convection of the cooling medium flowing over the bottle, and via conduction from the bottle through base 26 and thence to cold plate 95'.

On the other side of thermoelectric chip 91, fins 96 draw heat from hot side 93, and fan 97 blows air onto fins 96 to help remove heat therefrom. As shown in FIG. 10, fan 97 blows air upwards towards fins 96, however air can also be blown from one side of the fins to the other (i.e., into or out of the plane of the drawing). Additionally, fins 96 need not be directly attached to hot side 93 of chip 91. Instead, intermediate heat conducting structure, e.g., a heat pipe, metallic pipe, or similar structure, can be used to route the heat away from hot side 93 and be exposed to air currents remotely from chip 91.

One of the advantages of using a thermoelectric chip is that the relative temperatures of the sides of the chip can be reversed simply by reversing the current applied thereto. As such, by simply switching the current, cold plate 95, 95' could act as a hot plate to maintain a bottle and the contents of reservoir 24 ("warming medium") at a warm temperature. This warming feature is suitable for beverages such as apple cider (hard or otherwise), Irish coffee, some rum-based drinks, and the like. Optionally, a temperature sensor (not shown) may be provided coupled to a current controller which controls the current applied to the thermoelectric chip to maintain the cooling medium in equilibrium at a desired temperature. For example, if the temperature of the reservoir drops below a threshold during cooling, or above a threshold during warming, the current across the thermoelectric chip will be reversed so as to change the functioning of the thermoelectric chip from cooling to warming or vice versa. The temperature sensor may optionally cause the current controller to simply cut off the current supply to the thermoelectric chip, rather than actively reverse its function, when the temperature is determined to be too high or too low.

An optional lighting package 70 may be provided within the housing for purposes decoratively illuminating the bottle and other functions. For example, if base 26 is made translucent or transparent, LEDs 72 may be provided within base 26 to illuminate the bottle from underneath. The colors or brightness of the lights may be selected to indicate any or all of the following: the current temperature of the bottle (if a temperature sensor is also employed); how long the bottle has been chilled in the current cycle and/or how much time is left; etc. Other lights may be disposed in and around the housing as well, for example, on the front of housing 20, on wall 23, on or along the top portion 40 (described below), etc. Any or all of these lights may be adjustable in brightness, or made to flicker, etc.

The upper portion of the housing 20 includes a front wall 23 which is shown as sloping (but need not be sloping). Reservoir 24 is delimited at its uppermost point by ceiling 25, which also serves to provide additional structural integrity to the overall housing 20. The rear wall of housing 20 includes a fluid flow path 28 (e.g., piping), preferably integrally formed with housing 20. A pump 30 disposed within reservoir 24 draws cooling medium in from the reservoir and expels it up piping 32 and into fluid flow path 28 in the direction of the top portion 40 of device 10.

Figure 7:
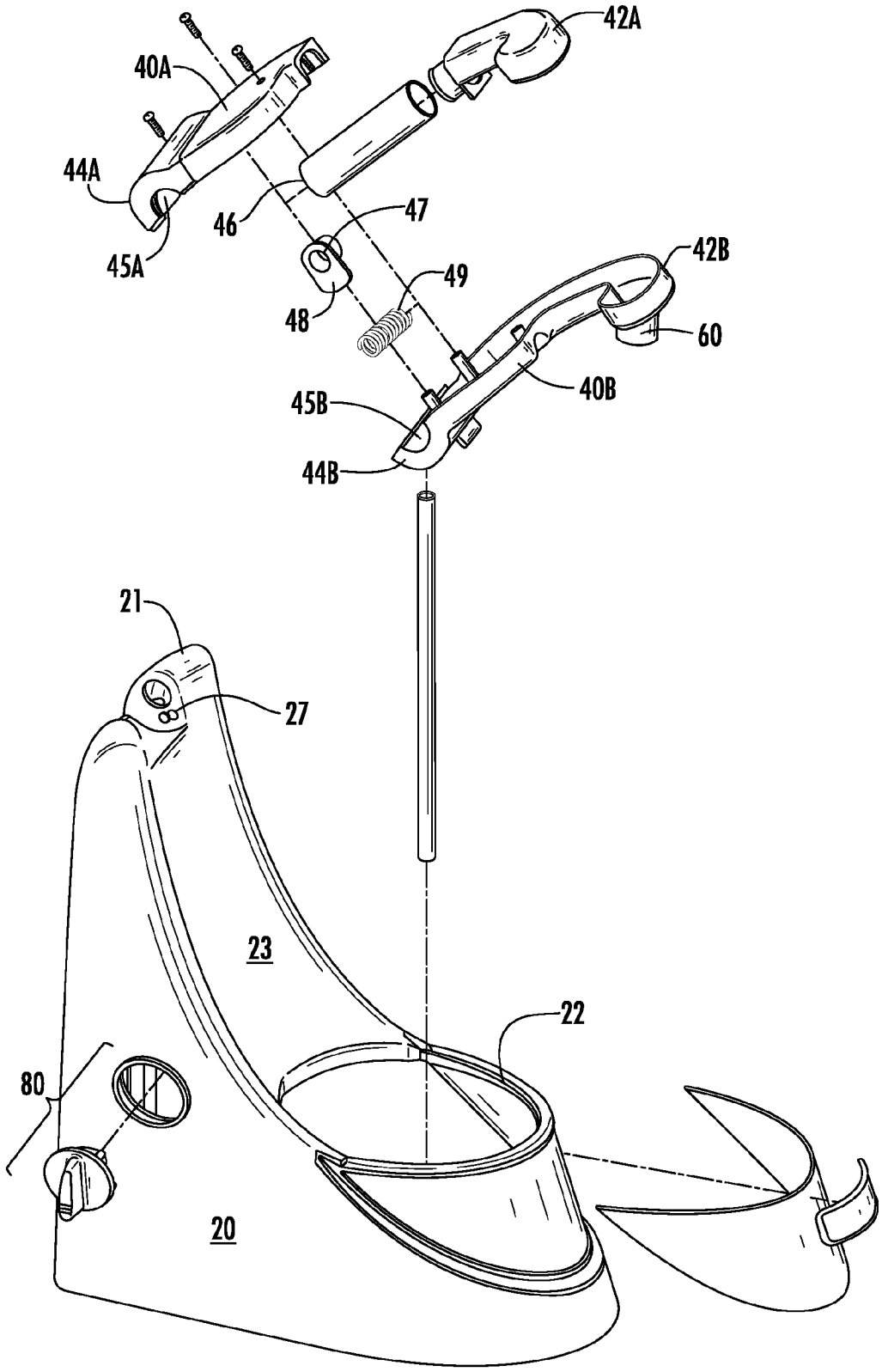
FIG. 7 is an exploded perspective view of the hook/spray jet of a wine bottle display stand in accordance with the invention.

Top portion 40 preferably includes at its distal end a hook 42 for receiving and securing neck 104 of bottle 100. The proximal end of top portion 40 preferably includes a hub 44 which is pivotably secured around pivot portion 21 of housing 20. As best shown in FIG. 7, a detent mechanism 47 includes a detent or bump 49 which interacts with mating recesses or divots 27. Two divots 27 are shown, corresponding to 750 ml and 1.5 L bottles, for example. Of course, more divots/positions may be provided for other sizes and shapes of bottles. The pivoting mechanism is preferably spring-biased by spring 49, for example, so as to allow top portion 40 to maintain a fixed position more securely.

As best shown in FIG. 7, top portion 40 is preferably hollow and includes fluid flow path 46 in fluid communication with fluid flow path 28. In one embodiment, the top portion is made from an upper section 40A and a lower section 40B. Upper section 40A includes upper hook half 42A and upper hub half 44A having concavity 45A. Lower section 40B includes corresponding mating lower hook half 42B and lower hub half 44B having concavity 45B. Lower hook half 42B preferably terminates in a nozzle or jet 60 out of which cooling medium pumped up flow paths 28 and 46 falls. Concavities 45A,B fit around pivot portion 21 of housing 20. Hook 42 shown in the figures comes around from the right side of the housing, however it can just as easily come around from the left side, or over the top, or any other convenient configuration.

So that hook 42 can better secure the neck of a bottle, part or all of the hook inner surface 43 may be provided with a no-slip material having a higher coefficient of friction than the rest of the housing. In one embodiment, surface 43 is provided with an adhesive. In addition or in the alternative, surface 43 is provided with a non-adhesive no-slip material such as neoprene. Other no-slip or otherwise gripping or adherent materials are also contemplated, provided they retain their relevant properties when wet and/or cold (e.g., 1-5° C.).

Bottle 100 is preferably held or maintained at an angle to vertical between 65 and 80 degrees, more preferably between 70 and 75 degrees, and most preferably at 73 degrees for the embodiment shown in FIGS. 1-7. By providing jet 60 above the shoulder 106 of bottle 100, cooling medium flowing out of jet 60 strikes the bottle substantially where neck 104 meets main section 102 at shoulder 106. By providing bottle 100 at or near the preferred angle to vertical, and by striking the bottle with the spray jet of cooling medium substantially at the shoulder 106 and/or the base of neck 104 of bottle 100, the cooling medium flows downward along the outside of main section 102 of bottle 100, clinging thereto in a thin film which serves to chill and then keep the contents of the bottle cool while providing an aesthetically pleasing waterfall-type display. To ensure excellent coverage of the bottle with the thin film but to minimize splashing, it is preferred to use a pump that provides between 5 and 8 liters/minute flow rate, and more preferably between 6.1 and 7.4 liters/minute. In addition, it is preferred that the flow rate of the cooling medium not come on at full blast upon initial activation of the pump; rather, it is preferred to ramp up the flow rate from zero to the desired level slowly to reduce initial splashing.

An offset rib or positioner of one form or another may also be provided along at least part of an inner perimeter of opening 22 to prevent the bottle from leaning directly against the side of the housing at opening 22. By spacing the side of the bottle from the rim of the opening, the positioner prevents cooling medium from travelling down the side of the bottle and flowing outside the housing. Instead, cooling medium travels down the side of the bottle and back into reservoir 24.

Figure 9A:
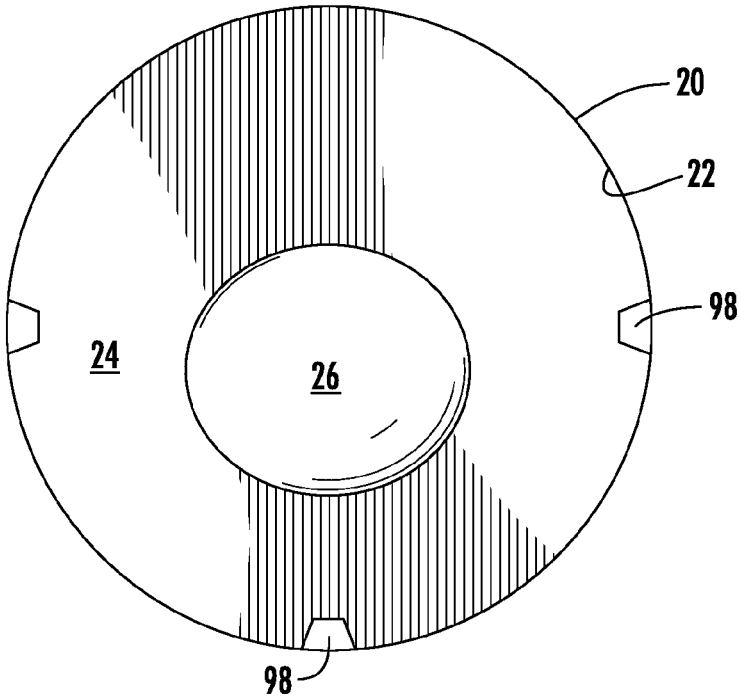
FIGS. 9A-B are top elevational views of bottle positioning structure in accordance with the invention.
Figure 9B:
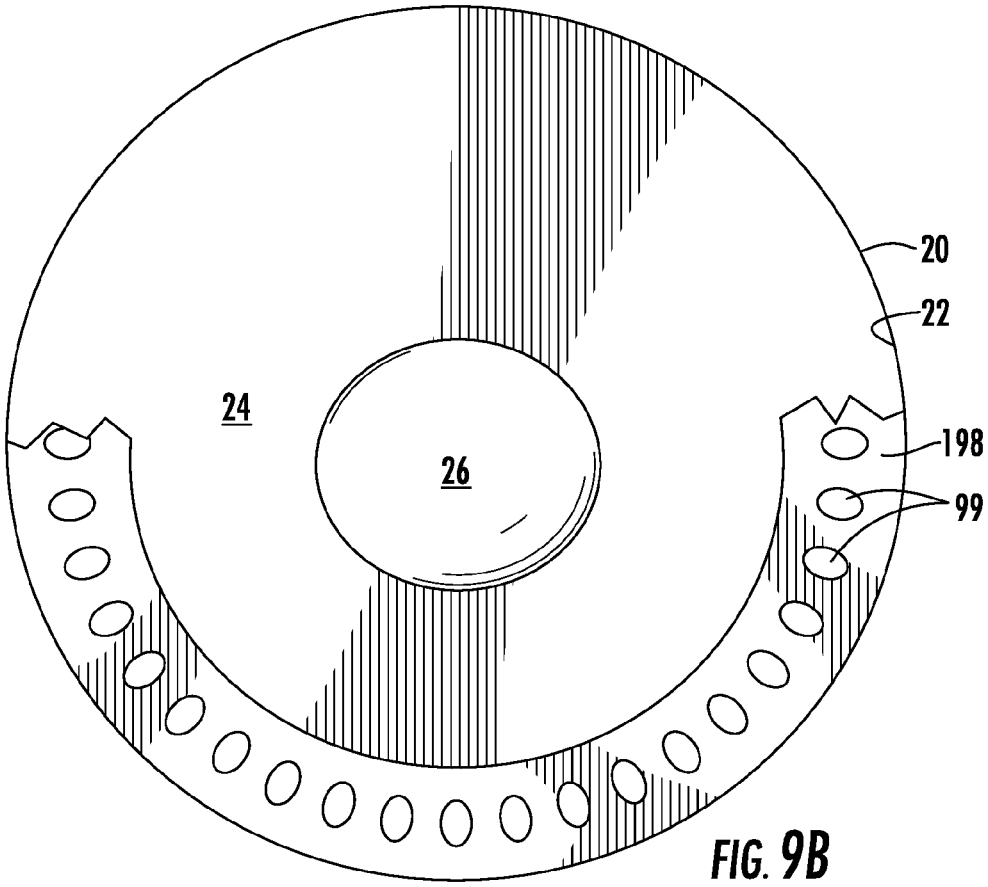

Two types of bottle positioners are shown in FIGS. 9A and 9B. In FIG. 9A, the bottle positioner includes at least one rib 98 (three are shown). Rib 98 is disposed on and projects from the inner surface of housing 20 below the rim of opening 22 so as to leave a gap between the bottle placed on base 26 and the rim of opening 22. Cooling medium travelling down the sides of the bottle will not spill over the sides of opening 22 or otherwise exit housing 20 but rather simply continue downward into reservoir 24.

In FIG. 9B, the bottle positioner includes a positioning flange 198, also projecting from the inner surface of housing 20 below the rim of opening 22. The punt of the bottle is rested on base 26, and the side of the bottle may contact flange 198, depending on the angle of the bottle caused by the position of the upper hook cradling the neck of the bottle. Preferably, flange 198 is scalloped so that cooling medium flowing down the side of the bottle will at least partially collect in flange 198. Flange 198 may be angled downward towards reservoir 24 so that cooling medium collected therein will simply flow down into the reservoir. Alternatively, drainage holes 99 may be provided through positioning flange 198 to allow cooling medium collected therein to fall into the reservoir. The embodiment shown in FIG. 9B depicts a number of drainage holes disposed throughout the flange, however far fewer holes 99—even as few as one—may be provided. In the case where only one drainage hole 99 is provided, it would be preferred to angle the positioning flange 198 towards that single drainage hole 99 so that the cooling medium drains efficiently and does not pool within the flange. As another alternative, a portion of or the entire flange 198 can be made from a wire mesh-type material (i.e., thus having a lot of holes). In any case, flange 198 is shown in FIG. 9B as extending roughly 180° around the circumference of the rim of opening 22, however it may extend more or less than that; flange 198 could be as small in extent as rib 98 of FIG. 9A or extend even fully 360° around the rim of opening 22 so as to fully "idiot-proof" the device.

In operation, the invention works as follows. It is desired to maintain a bottle of wine or similar beverage at a chilled or cold temperature. The reservoir 24 of housing 20 is filled with ice water via opening 22. Wine bottle 100 is placed within opening 22. If the wine bottle has a punt 101, the punt is places atop convex base 26. If the wine bottle has a flat base, base 26 may be removed. Top portion 40 is positioned so that hook 42 loops around neck 104 of bottle 100, thereby maintaining the bottle 100 at an angle of preferably 70-75 degrees from vertical. Device 10 is activated by operation of control 80. In a basic embodiment, control 80 is a simple on/off switch which activates pump 30. In a more advanced embodiment, control 80 includes a timing mechanism of some sort, be it a digital timer or a spring wound timer. In another embodiment, control 80 allows the user to select different flow rates depending on the size of the bottle being kept cold. The flow rate selector may be of the continuously variable type to also allow for reduced flow rates as the bottle is emptied by those enjoying its contents. Control 80 may take the form of a knob, buttons, keypad, or any known or to-be-developed type of control or actuator. In any event, the cooling medium (preferably ice water) is pumped up fluid flow path 28 into top portion 40 and falls out of jet or nozzle 60 substantially onto shoulder 106 of bottle 100, preferably near where neck 104 meets main section 102. The cooling medium falls over a substantial portion of the bottle and keeps the contents of the bottle cool while providing an aesthetically pleasing display that does not occlude or obscure the wine bottle or its label. A cooling unit, preferably a thermoelectric cooling unit, helps maintain the cooling medium and/or the bottle at a desired temperature. Preferably, the thermoelectric cooling unit simply draws heat from the reservoir to keep the cooling medium (and thus the bottle) as cold as possible. Optionally, the cooling unit is coupled to a temperature sensor which controls the operation of the cooling unit to maintain thermal equilibrium. Lights (preferably LEDs) illuminate the bottle for aesthetic purposes and to make the bottle more visible in a typically dark party or bar environment.

FIG. 8 depicts several different embodiments of the invention. FIG. 8A depicts a schematic version of the preferred embodiment of FIGS. 1-7, a top oriented jet. This embodiment provides excellent coverage of cooling medium over a variety of bottles and a good range of bottle angles. Further, this configuration offers minimal splashing of the cooling medium.

Figure 8A:
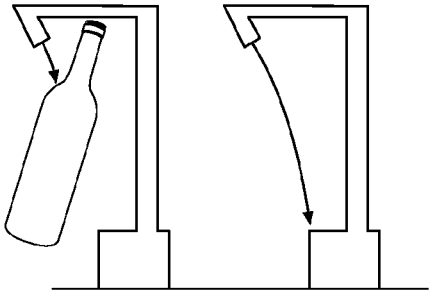
FIG. 8 is a series of schematics showing various configurations of the inventive wine bottle display stand.
Figure 8B:
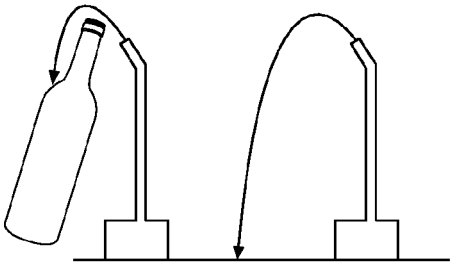

FIG. 8B depicts a schematic version in which the cooling medium is shot over the top of the bottle to land on the opposite side of the shoulder. This embodiment also works well over a range of bottle angles, however it carries a greater risk of splashing than that of FIG. 8A.

Figure 8C:
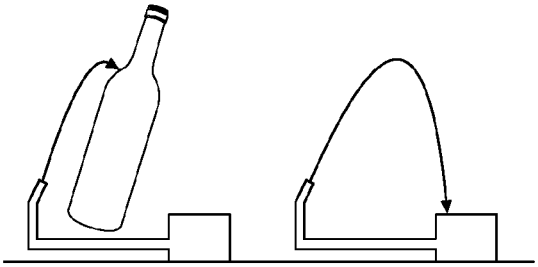

FIG. 8C depicts a schematic version in which the cooling medium is shot upward from the bottom to the top of the bottle to land on the shoulder. This embodiment works well with various types of bottles at varying angles, but carries a potential for splashing.

Figure 8D:
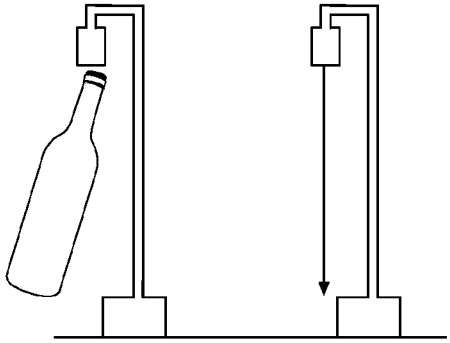

FIG. 8D depicts a straight overhead embodiment; splashing is minimized, however coverage provided by the cooling medium over the side of the bottle is less than optimal when the bottle is angled at the preferred angle for display purposes.

Figure 8E:
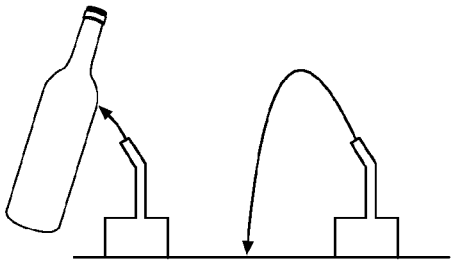

FIG. 8E depicts a rear-oriented cooling jet, which requires steep bottle angles and may provide less than optimal coverage for certain bottle types as well as splashing issues.

Figure 8F:
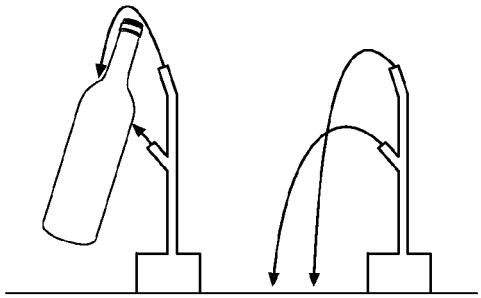

Finally, combinations of any of the above configurations of jets may be employed, as shown in FIG. 8F for example. However, by providing multiple jets, the various flow paths may interfere with each other, splashing may be exacerbated, and a more powerful pump may be required.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. A beverage bottle display stand comprising:

an at least partially hollow housing having an opening into which a bottle may be inserted within said housing at an angle from vertical;

a reservoir for a cooling medium disposed inside said housing;

a pump, in fluid communication with said reservoir, recirculating the cooling medium from the reservoir;

a fluid passageway in communication with said pump and terminating in an adjustably positionable spray jet; and a hook for receiving and engaging a neck of a bottle disposed in said opening, said hook helping to maintain the bottle at an angle from vertical when the base of the bottle is sitting within said opening of said housing, wherein said spray jet is directly aimed substantially at a shoulder region of a bottle placed in said opening so as to cause said cooling medium exiting said spray jet to flow down the sides of the bottle, wherein said hook is pivotably attached to said housing so as to accommodate bottles of different lengths having different shoulder heights, thereby making said spray jet adjustably positionable.

2. A beverage bottle display stand according to claim 1, wherein said hook is hollow and has an interior that forms a part of said fluid passageway, and said spray jet being in fluid communication with said interior of said hook.

3. A beverage bottle display stand according to claim 1, further comprising a rounded base disposed within said housing adapted to engage a punt of a bottle.

4. A beverage bottle display stand according to claim 3, wherein said base is removable.

5. A beverage bottle display stand according to claim 3, wherein said base is at least partially light transmissible and further comprises at least one light source disposed within said base adapted to illuminate a bottle placed thereon.

6. A beverage bottle display stand according to claim 1, further comprising a cooling unit in thermal communication with said reservoir adapted to remove heat from said cooling medium.

7. A beverage bottle display stand according to claim 6, wherein said cooling unit comprises a thermoelectric chip having a cold side and a hot side, said cold side being in thermal communication with said reservoir.

8. A beverage bottle display stand according to claim 2, further comprising a thermoelectric chip having a cold side and a hot side, said cold side being in thermal communication with said reservoir cooling unit in thermal communication with said reservoir adapted to remove heat from said cooling medium, wherein said cold side is disposed within said base and is also at least partially in thermal communication with the wine bottle disposed on said base so as to provide cooling of the bottle via both i) forced convection of the cooling medium flowing over the bottle and ii) conduction from the bottle through said base to said cold side of said thermoelectric chip.

9. A beverage bottle display stand according to claim 1, further comprising at least one positioning rib, projecting from an interior of said housing below a rim of said opening, adapted to contact a side wall of the bottle so as to space the bottle away from said rim so as to prevent said cooling medium flowing down the bottle from exiting the housing.

10. A beverage bottle display stand according to claim 1, further comprising a positioning flange disposed within said housing below a rim of said opening, adapted to contact a side wall of the bottle so as to space the bottle away from said rim so as to prevent said cooling medium flowing down the bottle from exiting the housing.

11. A beverage bottle display stand according to claim 10, said positioning flange further comprising at least one drainage hole, wherein cooling medium flowing down the bottle is at least partially collected within said positioning flange, exits said positioning flange via said at least one drainage hole, and returns to said reservoir.

12. A beverage bottle display stand according to claim 11, wherein said positioning flange is angled towards said at least one drainage hole so that cooling medium collected in said flange flows downward in said flange towards said drainage hole.

13. A beverage bottle display stand according to claim 10, wherein said positioning flange is angled so that cooling medium collected in said flange flows downward in said flange and into said reservoir.

14. A beverage bottle display stand according to claim 7, wherein a current applied to said thermoelectric chip is selectively reversible, thereby causing said hot side to be in thermal communication with said reservoir and thus warm said reservoir and the bottle.

15. A beverage bottle display stand according to claim 8, wherein a current applied to said thermoelectric chip is selectively reversible, thereby causing said hot side to be in thermal communication with said reservoir and the bottle via said base and thus warm said reservoir and the bottle.

16. A beverage bottle display stand according to claim 1, wherein a surface of said hook includes a no-slip material having a higher coefficient of friction than said housing to further secure the neck of the bottle.

17. A beverage bottle display stand according to claim 16, said no-slip material includes an adhesive.

* * * * *